United States Patent [19]

Laitinen et al.

[11] Patent Number: 4,552,619

[45] Date of Patent: Nov. 12, 1985

[54] THERMAL STABILIZING SYSTEM FOR A HEADBOX OF A PAPERMACHINE

[75] Inventors: Sakari Laitinen, Huutjärvi; Tapani Nyman, Karhula, both of Finland

[73] Assignee: A. Ahlstrom Osakeyhtio, Noormarkku, Finland

[21] Appl. No.: 600,429

[22] Filed: Apr. 16, 1984

[30] Foreign Application Priority Data

May 11, 1983 [FI] Finland ..... 831634

[51] Int. Cl.[4] ..... D21F 1/02; D21F 1/04

[52] U.S. Cl. ..... 162/336; 162/344

[58] Field of Search ..... 162/336, 344, 337, 338, 162/339, 347

[56] References Cited

U.S. PATENT DOCUMENTS 3,468,756 9/1969 Villa ..... 162/344

4,455,197 6/1984 Croteau et al. ..... 162/344

FOREIGN PATENT DOCUMENTS 849817 8/1970 Canada ..... 162/336

*Primary Examiner*—William F. Smith

*Assistant Examiner*—K. M. Hastings

*Attorney, Agent, or Firm*—Bucknam and Archer

[57] ABSTRACT

The outer walls of the beams of a papermachine headbox are heated by means of heat transferred from the stock to a temperature equal to that of the inner walls in contact with the stock. This is preferably carried out so that the liquid which is circulated in a closed liquid circulation through liquid spaces adjoining the outer walls, is caused to be in indirect heat transfer contact with the stock.

4 Claims, 2 Drawing Figures

THERMAL STABILIZING SYSTEM FOR A HEADBOX OF A PAPERMACHINE

BACKGROUND OF THE INVENTION

The present invention is related to a thermal stabilizing system for a papermachine headbox, wherein the surfaces of the beams of the headbox which are in contact with the surrounding atmosphere are heated to the same temperature as the surfaces which are in contact with the stock material flow in a papermachine.

When the temperature of the stock varies, the beams of a headbox tend to deform due to temperature differences formed between the surfaces in contact with the stock.

Due to the deformations of the beams, changes occur in the stock cross-section of the flow. These changes are detrimental, at the outlet point of the stock in particular.

The flow rate of the stock flowing out from the headbox should remain constant across the entire width of the flow area within an accuracy of 1 to 2%.

The height of the flow outlet should remain constant in the same accuracy range. For example, if the slice opening is 10 mm, it should vary about 0.1 mm at the most across the entire width of the lip, which can be about 5 to 10 m.

It is known that attempts have been made to control the deformations of headbox beams by heating or cooling the surfaces which are in contact with air. The controlling is carried out by measuring the stock temperature or the beam deformation.

For example, Canada Pat. No. 849817 discloses a headbox wherein a liquid is heated to a temperature substantially equal to the stock temperature and is caused to flow in contact with the supporting frame of the headbox. The system comprises automatic control apparatuses for maintaining the temperature and the rate of flow of the liquid within preset limits.

SUMMARY OF THE INVENTION

It is an object of the present invention to provide a simple and reliable thermal stabilizing system for a papermachine headbox wherein no control devices are required.

The invention is characterized in that the outer walls of the headbox beams are heated by means of the heat transferred from the flowing stock.

Preferably the stock is caused to be in indirect heat transfer contact with a forced circulation liquid which circulates through liquid spaces disposed in the beams.

BRIEF DESCRIPTION OF THE DRAWINGS

The invention will be described in more detail in the following with reference to the accompanying drawings. In the drawings.

DESCRIPTION OF THE PREFERRED EMBODIMENTS

Figure 1:
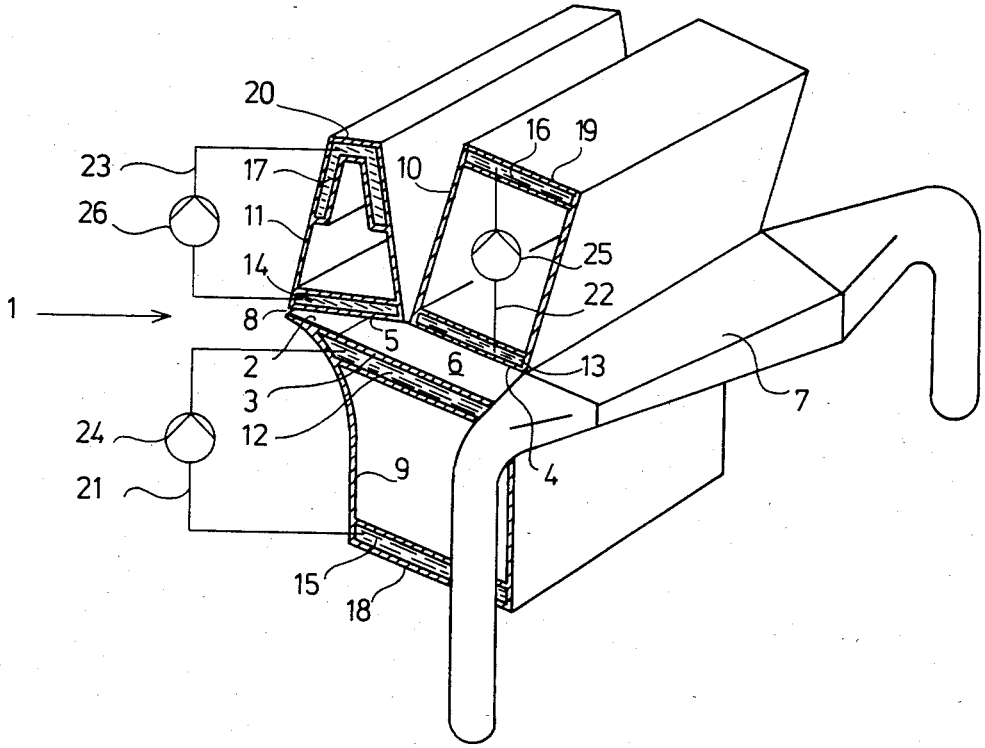
FIG. 1 is a perspective view of an embodiment of the invention.

Referring now to the drawings, in FIG. 1 the reference numeral 1 indicates the headbox of a papermachine provided with a flow chamber 6 consisting of a lower lip plate 2, bottom plate 3, top plate 4 and an upper lip plate 5, whereto stock is fed from a manifold pipe 7. The headbox 1 supplies stock to the wire of the papermachine (not shown) through a slice 8. Adjustment of the size of the slice is achieved in a manner known per se, but not described more exactly here.

The structure of the headbox comprises beams 9, 10 and 11. The beams are provided with liquid spaces 12–17 which are adjoining the inner walls 2–5 and the outer walls 18, 19 and 20 of the beams. The liquid spaces 12–17 adjoining the inner and outer walls of each beam are coupled to the same closed liquid circulation system 21, 22 and 23 in which the liquid is circulated through the liquid spaces by means of a pump 24, 25 and 26.

Heat is transferred by means of indirect heat transfer contact through the inner walls 2–5 in contact with the hot stock to the liquid of the liquid circulation system which heats the outer walls 18, 19, and 20 of the beams to a temperature equal to that of the inner walls. As the temperature is the same on the opposite walls of the beam, there is no difference in the thermal expansion between the walls and the beam remains undistorted.

Figure 2:
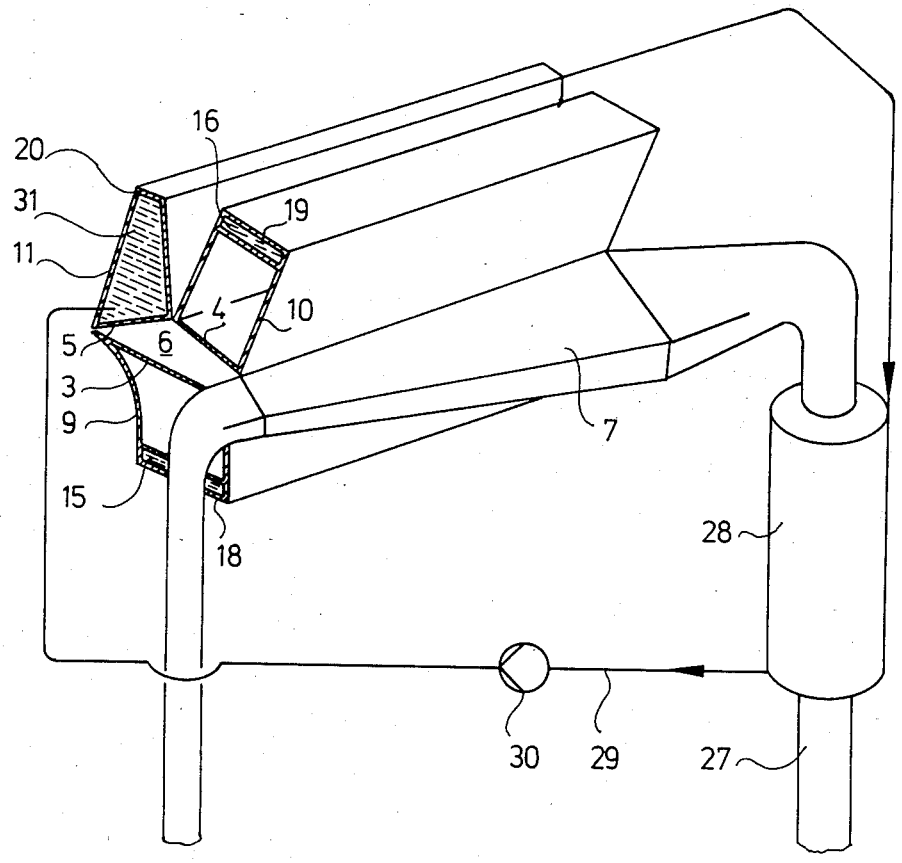
FIG. 2 is a perspective view of another embodiment of the invention.

FIG. 2 shows another embodiment of the thermal stabilizing system for a headbox in accordance with the invention. A liquid mantle 28 is provided around an inlet pipe 27 for carrying the stock leading to the manifold pipe 7 of the headbox. Liquid in conduit 29 passing through the liquid mantle 28 is circulated by means of a pump 30 to a liquid space 31 formed in the beam 11. In the liquid mantle 28, heat is transferred from the stock by means of indirect heat transfer contact to the circulating liquid so that its temperature is substantially equal to that of the stock. As the outer wall 20 of the beam 11 and the inner wall 5 are adjoining the liquid space through which the liquid heated by the stock flows, their wall temperature is the same and the thermal expansion equal. The liquid spaces 15 and 16 of beams 9 and 10 are connected to the liquid circulation at conduit 29 in parallel or in series with the liquid space 31. In beams 9 and 10 the stock in the flow chamber 6 heats the inner walls 3 and 4 and the liquid in the liquid spaces adjoining the outer walls 18 and 19 heats the outer walls. It is evident that the structures of the beam 11 and beams 9 and 10 are alternative solutions.

While specific embodiments of the invention have been described in detail above, it is to be understood that various modifications may be made from the specific details described without departing from the spirit and scope of the invention. Accordingly, the system in accordance with the invention may be utilized for cooling the outer walls of the beams to the temperature of the stock in case the temperature of the surrounding atmosphere is higher than that of the stock. The invention may also be applied in headboxes, the structure of which is different from that of the preferred embodiments. The medium used for heating may also be a liquid obtained from some other stage of the process and having a temperature substantially equal to that of the stock fed to the beam headbox.

We claim:

1. In combination with a papermachine headbox, a thermal stabilizing system for said headbox, comprising:

a lower box beam and at least one upper box beam, said box beams being positioned to support said headbox, each said beam having an inner wall in contact with a stock flowing through said headbox and an outer wall and each said beam being provided with at least one liquid space extending lengthwise of the beam and adjoining each said inner and outer wall, each said liquid space having a liquid, separate from said stock, flowing therethrough;

liquid circulation means for circulating the liquid between each said space of each beam, and means for heating said outer walls to a temperature equal to that of the inner walls, said heating means consisting of the flowing stock, by heat transfer from the flowing stock to the liquid flowing through the liquid spaces in the box beams, and said thermal stabilizing system being devoid of control devices.

2. A thermal stabilizing system for a headbox as defined in claim 1, wherein said liquid circulation means is a closed liquid circulation system which circulates the liquid through the liquid spaces disposed in said beams.

3. A thermal stabilizing system for a headbox as defined in claim 1, wherein a liquid mantle is provided around a stock inlet pipe of the headbox, and the liquid is passed through said liquid mantle and is circulated through the liquid spaces in the beams to heat the outer walls of the beams.

4. A thermal stabilizing system for a headbox as defined in claim 2, wherein at least one of said beams is provided with two liquid spaces, one of said two liquid spaces adjoining the inner wall of said at least one beam, the other liquid space adjoining the outer wall of said at least one beam, and said two liquid spaces are each connected by the closed liquid circulation system.

* * * * *